United States Patent [19]

Williams et al.

[11] 4,215,831

[45] Aug. 5, 1980

[54] WINDING APPARATUS

[76] Inventors: Robert A. Williams, 165 Garfield Dr., Painesville, Ohio 44077; William A. Cotton, 10803 Kile Rd., Chardon, Ohio 44024; Robert B. Hoskinson, 9124 Highland Ct., Mentor, Ohio 44060

[21] Appl. No.: 55,276

[22] Filed: Jul. 6, 1979

Related U.S. Application Data

[63] Continuation of Ser. No. 864,832, Dec. 27, 1977, abandoned.

[51] Int. Cl.[3] ..... B65H 54/28

[52] U.S. Cl. ..... 242/158 F; 242/67.1 R; 242/DIG. 2

[58] Field of Search ..... 242/158 R, 158 F, 158 B, 242/158.2, 158.3, 158.4 R, 158.4 A, 158.5, 18 R, 25 R, 55, 67.1 R, DIG. 2

[56] References Cited

U.S. PATENT DOCUMENTS

| | | | |
|---|---|---|---|
| 1,267,080 | 5/1918 | Judelshon | 242/DIG. 2 |
| 3,433,434 | 3/1969 | Latter | 242/158 R |
| 3,598,337 | 8/1971 | Mackie | 242/158 R |
| 3,820,729 | 6/1974 | Springer et al. | 242/158 R X |
| 3,829,037 | 8/1974 | Sallin | 242/158 R X |
| 3,963,186 | 6/1976 | Van den Aa | 242/158 R X |
| 3,979,084 | 9/1976 | Ruhl et al. | 242/158 F |

*Primary Examiner*—Stanley N. Gilreath
*Attorney, Agent, or Firm*—Vytas R. Matas

[57] ABSTRACT

Apparatus for helically winding a web or ribbon material on a mandrel. The web is wound in traversing or helical fashion by means of a guide wheel which is mechanically independent of the rotational movement of the mandrel. Lateral movement of the guide wheel is provided by a hydraulic cylinder pressurized through a servo valve controlled by an electronic position regulating system including absolute position feedback.

12 Claims, 4 Drawing Figures

WINDING APPARATUS

This is a continuation of application Ser. No. 864,832, filed Dec. 27, 1977, now abandoned.

PRIOR ART STATEMENT

The following reference is considered to be relevant to the present invention:

U.S. Pat. No. 3,963,186 discloses a winder including traversing means for helically winding a tape onto a mandrel or spool. Movement of the traversing means is controlled by a mechanical connection with means provided for driving the mandrel.

This invention relates generally to winding apparatus, and more particularly to apparatus for helically winding web or ribbon material onto a coil without side plates, and to a control system therefor.

In a continuous process for winding a narrow web, it is advantageous to wind as long a length as possible by winding material in traverse or helical fashion in multiple layers. It is particularly difficult to helically wind relatively rigid materials. As each layer is formed in the winding process a void is left as the web moves from the edge of the coil. When the next layer is formed it must be placed in such a manner that is does not fall into the void in the previous layer as the web approaches the edge of the coil.

Of further concern in winding rigid material is crowning at the edge of the coil, and other mechanical effects of crowning. Since rigid web does not deflect, the instant the direction of the helix changes, the web increases to the next layer, and any delay in traverse motion at the edge will result in a double layer at the edge. The reversing motion must be fast, and the web must progress accurately along the helix, so that the web never overlaps at any point along the helix.

Prior art winders, such as that disclosed in U.S. Pat. No. 3,963,186, have relied on mechanical means interconnecting the mandrel on which the coil is wound and the traversing mechanism to control the helical winding of the web material on the mandrel. With such mechanical means it is difficult to achieve the precise control required to avoid placing the web in the helical void of the previous layer, and to avoid winding with overlap.

It is thus an object of the present invention to provide a coil winding apparatus and control therefor which will helically wind a coil of web or ribbon material of a wide range of thicknesses and widths without the use of side plates.

Another object of the invention is to provide a winder and control therefor wherein the web helix is formed on the mandrel without placing the web in the helical void of the previous layer.

Another object of the invention is to provide a winder and control therefor in which the web helix is accurately formed without overlap.

To meet the above objectives, the present invention provides a winder in which the web material is directed over a guide wheel which is laterally movable to wind the web material in traversing or helical fashion first over a placing roll and then onto a powered rotating mandrel. The lateral movement of the guide wheel is controlled by a linear actuator which is mechanically independent of the rotational movement of the mandrel. The linear actuator is a hydraulic cylinder, the velocity and force of which is controlled by a servo valve to provide electrical control of the guide wheel and web position. Absolute linear feedback using a linear variable differential transformer (LVDT) is used for accurate position control. Absolute position feedback insures that the coil edges will be both straight and parallel since errors are not cummulative or remembered. Coil reversal points are controlled electronically, and can be adjusted depending on the material and cross section of the web or ribbon to be wound.

Two operator controlled settings are required to set up the winder to form a coil of a given material, the number of whole and fractional turns desired across the coil and the lead or inches of lateral movement of the guide wheel per revolution of the coil. The settings are made by thumbwheel switches connected to the electronic controls.

Guide wheel position reference is determined electronically based on mandrel rotation and the operator settings of number of turns and desired lead. Actual guide wheel position is controlled by a closed loop feedback control system to follow the position reference with a high degree of accuracy such that spools or side plates are not required for a broad range of wound materials.

Index logic is included to allow for easy coil removal and proper orientation of the guide wheel and the mandrel for the beginning of a new coil.

Other objects and advantages of the invention will become more apparent from the following description when taken in connection with the accompanying drawings, wherein.

Figure 1:
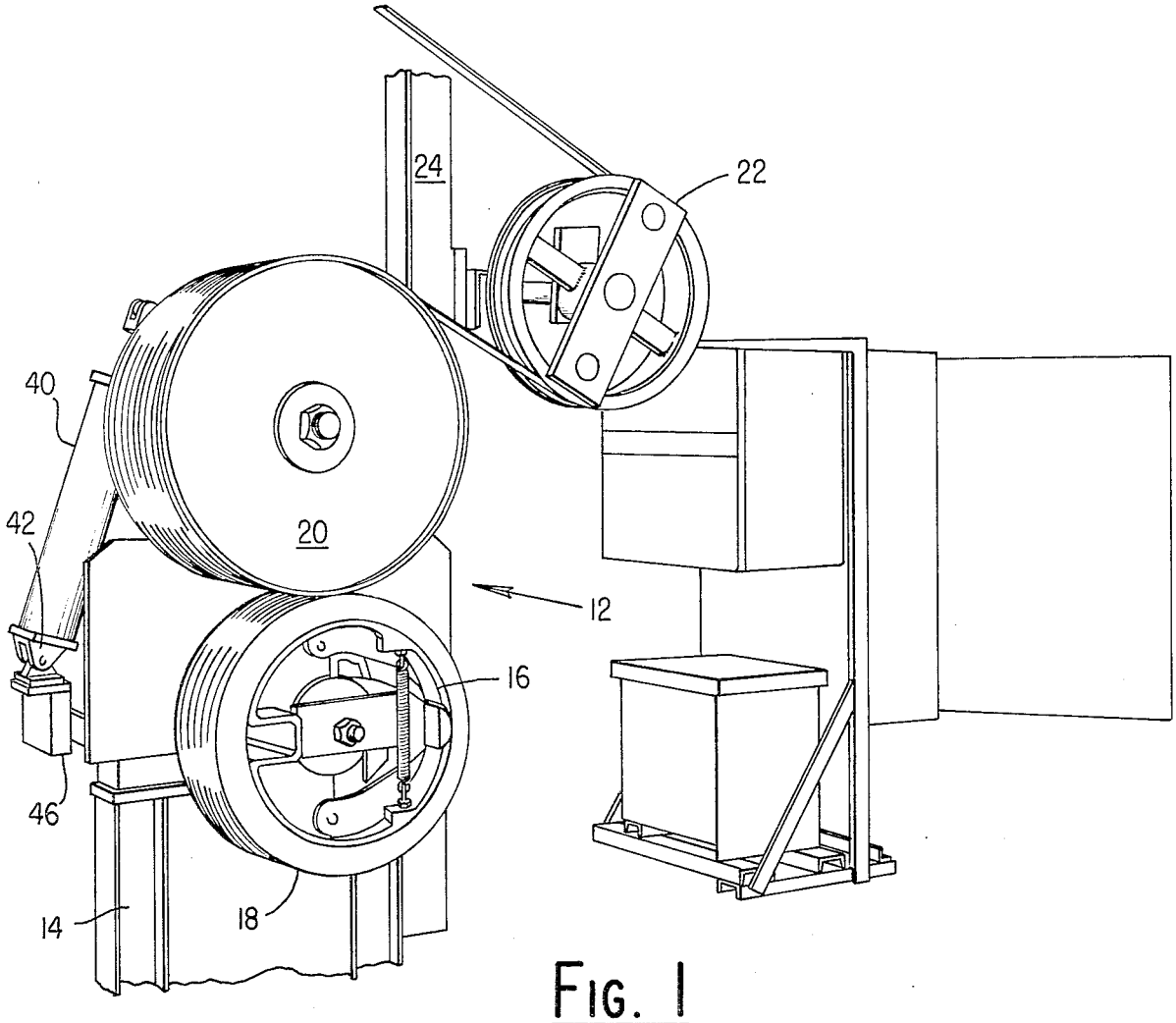
FIG. 1 is a perspective view of the apparatus of the invention.

Referring to the drawings, the traverse winder, designated generally by the numberal 12, comprises a base 14; a mandrel 16, rotatably mounted on the base 14, on which the web material 18 is wound; a placing roll 20 which is movable in an arcuate path toward and away from the mandrel 16; and a traversing guide wheel 22, which controls the placement of the web material onto the placing roll 20, and then onto the mandrel 16.

In the preferred embodiment the web material is metal sheet strip, but clearly the described apparatus is effective to wind any web or ribbon material.

The web material 18 is directed from another process (not shown) to the guide wheel 22, is looped around the guide wheel to the placing roll 20, and then onto the mandrel 16. The mandrel 16 is driven by a conventional motor 17 and chain drive assembly (not shown) located within the base 14. The placing roll 20 and the guide wheel 22 rotate freely, being turned by the movement of the web material and are mounted for rotation on a vertical frame assembly 24 attached to the base 14.

Figure 2:
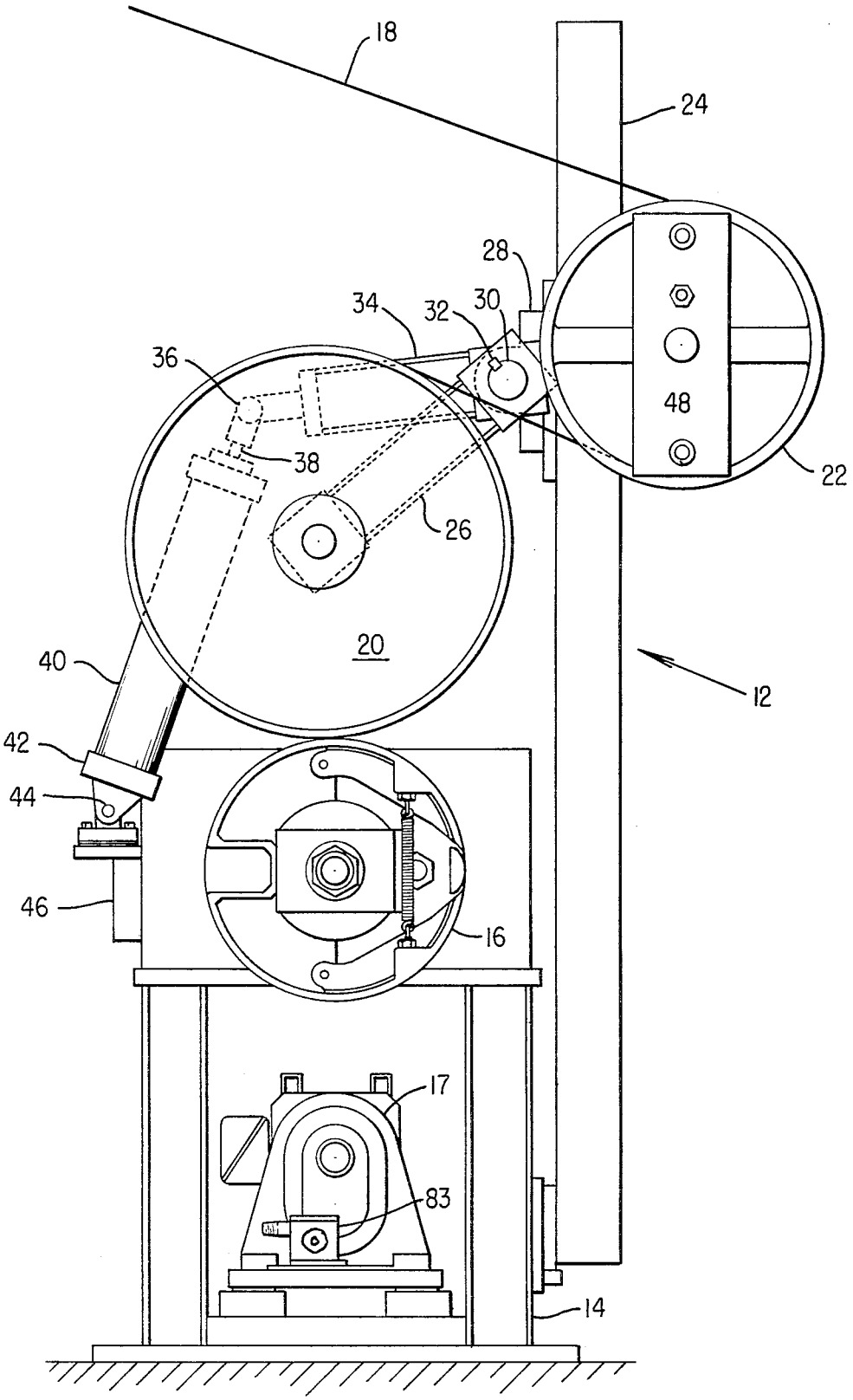
FIG. 2 is a front elevation view of the apparatus of FIG. 1.

The placing roll 20 is adapted to rest on the coil of web material as it is built up on the mandrel. To this end, the placing roll 20 is rotatably mounted on an arm 26 which is pivotally mounted on the vertical frame assembly 24. Referring particularly to FIG. 2, a bearing block 28 is mounted on the side of frame 24. A shaft 30 is rotatably received in the bearing block 28, and the arm 26 is fixed by means of a key 32, to one end of shaft 30, which protrudes through one side of the bearing block 28. One end of a second arm 34 is similarly fixed to the end of the shaft 30 protruding through the opposite end of the bearing block 28. The opposite end of the second arm 34 is attached by means of a clevis assembly 36 to the piston rod 38 of a hydraulic cylinder 40. The head end 42 of the cylinder 40 is pivotably attached at 44 to a bracket 46 welded or otherwise attached to the base 14. In normal operation, the placing roll 20 applies some pressure against the coil by means of the pressurization of the rod end of cylinder 40 and pivots clockwise about the axis of shaft 30 from the position of FIG. 2 in contact with the first layer of material wound onto the mandrel 16, to the position in contact with the last layer of a fully formed coil as seen in FIG. 1.

Pressurization of the head end of the cylinder 40 to extend piston rod 38 and lift the placing roll 20 off the surface of the coil is governed by a control system which will be discussed later.

The guide wheel 22 is mounted for rotation about an axis 48 which is parallel to the axis of rotation of the mandrel 16 and the shaft 30, and is movable along axis 48 to helically wind the web material 18 onto the placing roll 20.

Figure 3:
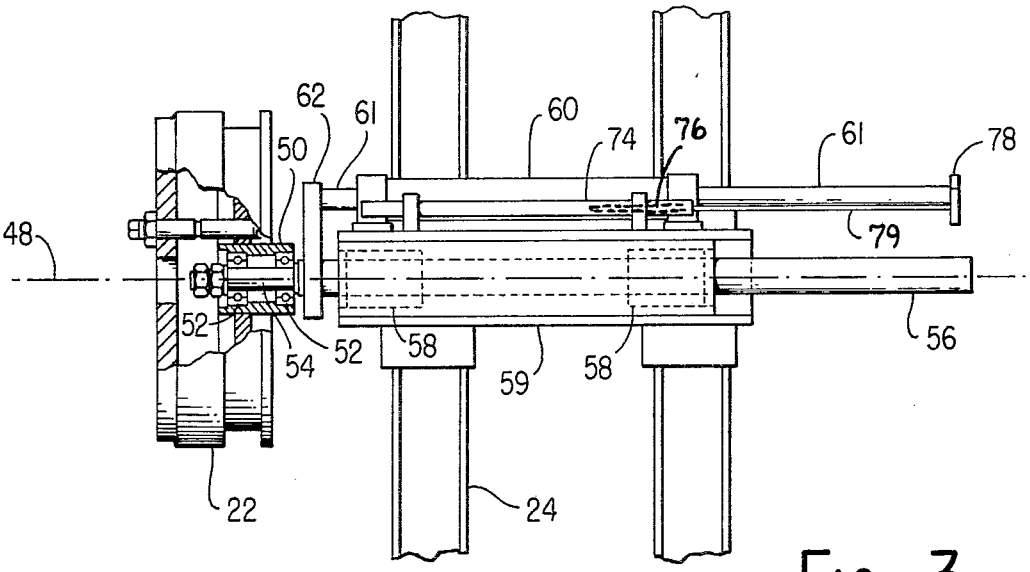
FIG. 3 is a fragmentary side elevation view of the guide wheel assembly of FIG. 1, with parts shown in section.

Referring to FIG. 3, the guide wheel 22 includes a hub 50 which receives anti-friction bearings 52. The bearings 52 ride on a reduced diameter section 54 of a shaft 56 which is supported for movement along axis 48 in linear ball bushings 58 received within a housing 59 mounted on the vertical frame assembly 24. The shaft 56 is moved along the axis 48 by means of a double acting hydraulic cylinder 60 mounted on the frame assembly 24 parallel to the shaft 56. The piston rod 61 of cylinder 60 and guide wheel shaft 56 are linked together by means of a plate 62 attached by any convenient means to the rod and the shaft such that pressurization of cylinder 60 will produce traversing movement of the guide wheel 22 along axis 48. Pressurization of the cylinder 60 is governed by a control system which will be described later.

Figure 4:
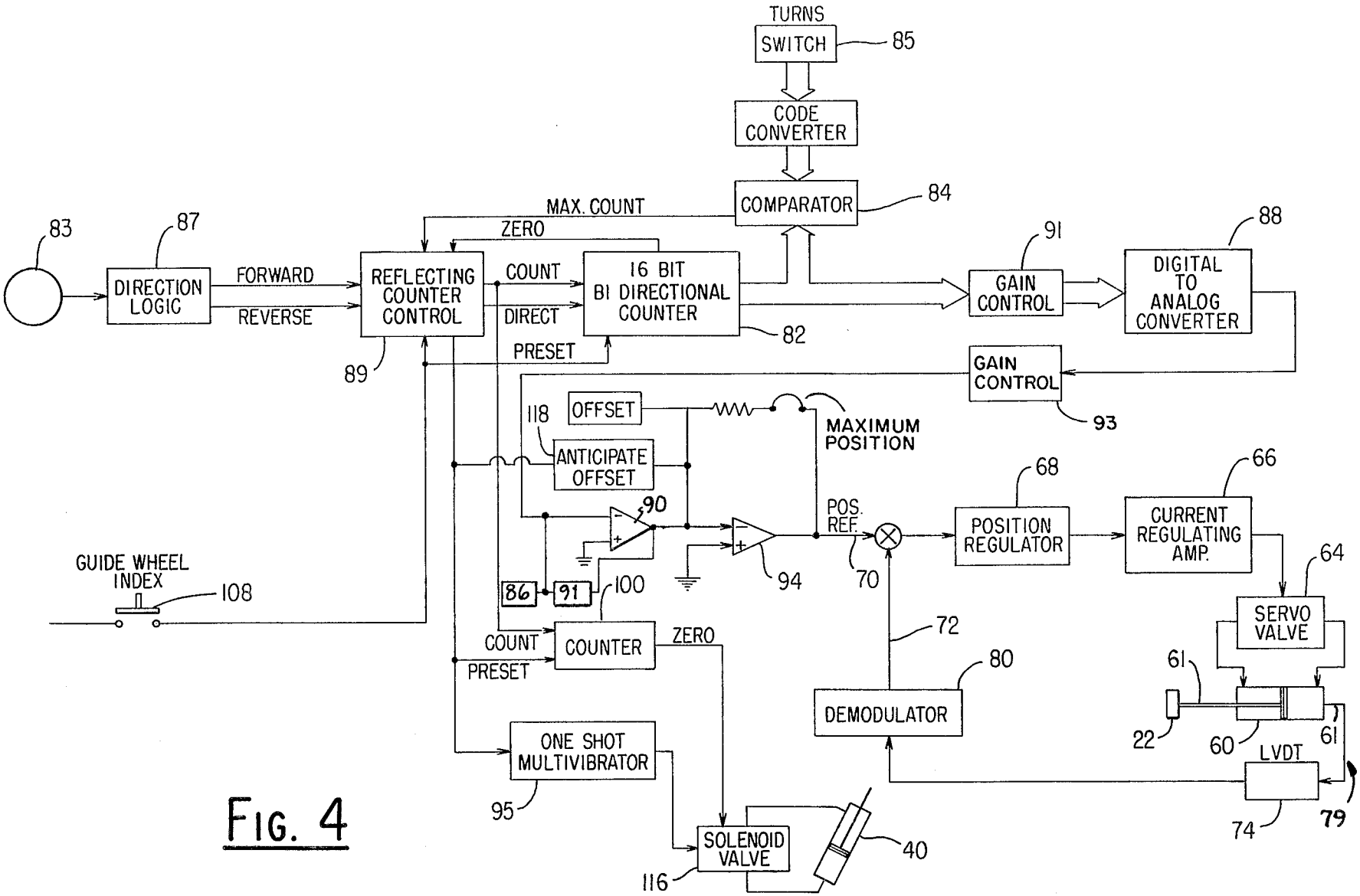
FIG. 4 is a schematic block diagram of the control system of the invention.

Referring to FIG. 4, the winder control system is designed to control the position of the guide wheel 22 as a function of the rotation of the mandrel 16 and the operator controlled settings of the turns and lead to allow the winding of web material on a mandrel having no side plates.

As described above, the guide wheel 22 is moved along axis 48 by the cylinder 60. The flow of the oil to the cylinder 60 is controlled by a servo valve 64, which is connected to a conventional source of pressurized oil (not shown). Current to the servo valve 64 is controlled by a current regulating amplifier 66, such that the spool position of the servo valve 64 is proportional to the output signal from the position regulating amplifier.

The inputs to the position regulating amplifier 68 are the position reference and the position feedback signals designated 70 and 72 respectively in FIG. 4.

The actual absolute position of the guide wheel 22 is converted to an electrical signal by a linear variable differential transformer (LVDT) 74 with a movable core 76. The primary winding of the LVDT is fed a precisely regulated sine wave voltage. The movable core changes the coupling of the primary winding to the two secondary windings with one of the secondary windings receiving a maximum signal and the other a minimum signal at one end of the travel. The coupling changes linearly as the core is moved to the other end with the opposite windings being at maximum and minimum. The core of the LVDT is connected to the piston rod 61 of the cylinder 60 so that its position in the LVDT 74 matches the movement of the guide wheel 22. Referring to FIG. 3 the LVDT 74 is mounted on the frame assembly 24 adjacent and parallel to the cylinder 60 with its movable core 76 connected to the piston rod 61 by means of a core connecting rod 79 and a plate 78 attached by any convenient means to the piston rod and the core. The two secondary winding signals are connected to a demodulator circuit 80 which removes the carrier and develops a DC voltage proportional to the position of core 76. The carrier is the A.C. component of the precisely regulated sine wave voltage mentioned above. To remove the carrier means to remove the sinusoidal portion of the voltage present on the secondary windings of the LVDT 74. This voltage is the position feedback signal represented by the numeral 72, providing a highly accurate and proportional signal, indicating of actual guide wheel position.

The position reference signal 70 is a function of the count in the turns counter 82 and the lead setting. The turn counter counts the pulses from an incremental encoder 83 driven by the mandrel 16 by a chain connection (not shown).

The direction logic block 87 is a generally known circuit to use the phase relationship of the A and B output pulses from the incremental encoder 83 to develop forward and reverse signals for use by the reflecting counter control.

The maximum count that the counter is allowed to go is determined by a comparator 84 which compares the count in the counter 82 to the operator setting on a turns thumbwheel switch 85 plus a preset predetermined partial turn. The output of the comparator goes to the reflecting counter control which will reverse the direction of the counter 82. The count direction is also reversed by the reflecting counter control 89 when the count reaches zero. Thus, the counter counts up and down between zero and the number of turns, plus a partial turn at a rate proportional to the mandrel speed, then keeping in locked step with the angular position of the mandrel.

If the maximum number of turns is less then sixteen (16) then the top two bits in the counter will not be used so the count is shifted over two places by the gain control circuit 91 to use the maximum resolution in a digital to analog (D/A) converter 88. The gain control circuit 91 shifts the digital information two bits or changes the amplification by a factor of four. The modified count logic levels are converted to an analog voltage in the D/A converter. This voltage then goes to the lead amplifier 90. In this amplifier the gain is proportional to the setting of the lead thumbwheel switch 92. The gain of amplifier 90 is the value of amplification required to produce a change in position reference voltage equivalent to the lead setting when the value in the counter is increased by one turn. A signal equal to one turn is added by a bias station 86 at amplifier 90. This compensates for the width of the material and allows the windings to always start on the outside edge of the mandrel. Also, in the amplifier 90 the gain is adjusted by the second gain control 93 to compensate for the resolution shift in the D/A converter input. The gain control 93 operates inversely to the gain control circuit 91 producing a unity gain overall but with greater resolution whenever the number of turns is less than 16. The output of the lead amplifier then goes to another amplifier 94 where the signal is adjusted for offset and maximum position. The output of this amplifier is then the position reference signal 70 which goes to the position regulating amplifier 68 to ultimately control the position of the guide wheel 22.

At the start of a new coil the web material is threaded around the guide wheel 22, around the placing roll 20 and is attached to the top of the rewind mandrel 16 and at the front face by any suitable conventional means. The guide wheel index pushbutton 108 must then be pushed to preset the turns counter 82 to a fixed pre-set count. This count represents the amount of material between the top of the mandrel and the guide wheel and the number of turns the mandrel would make while winding the length of strip from mandrel 16 and guide wheel 22. This presets the helix required to wind the first full layer on the mandrel. Thus the guide wheel position reference has been properly adjusted for the start of the coil.

As the winder operates, the guide wheel 22 traverses back and forth along axis 48 to helically wind the web material onto the placing roll 20, which then deposits the material onto the mandrel 16. The traversing movement of the guide wheel is precisely controlled electronically in step with the rotation of the mandrel 16.

In accordance with one aspect of the invention a circuit is included to lift the placing roll 20 a small distance off the material 18 wound on the mandrel 16 in order to improve reversal of the material at the coil edge. Normally the placing roll 20 is operated with a downward pressure toward the mandrel 16. At reversal of web travel, the web must walk back on itself and raise its position to the next layer. Without mechanical force or restraint to keep the web from following the previously laid wrap, the web must depend on friction at the web edge to raise itself to the next layer. The transport lag of the reversal between the guide wheel 22 and the coil is utilized. At guide wheel reversal a one-shot multivibrator 95 is triggered to raise the placing roll 20 for a fixed time. The gap thus produced between the coil and the placing roll is maintained until the reversal is translated to the coil, plus some arbitrary travel of the coil. Once the reversal and subsequent raising of the web to the next layer is accomplished and the web has travelled a sufficient distance to be fully supported by the previous layer, the placing roll 20 is again lowered to the coil surface. This is accomplished by a counter 100 which was preset at the reversal point. The counter 100 counts the pulses from the incremental encoder 83 until it reaches zero where it will give a signal to lower the placing roll 20 to its normal position against the coil. The signals from one-shot multivibrator 95 and counter 100 are fed to a solenoid valve 116 which controls the pressurization of cylinder 40.

In accordance with another aspect of the invention an extra jump is provided in the position reference for the guide wheel at reversal points. This feature is a small position offset toward the machine, represented by the numeral 118, which is added when the guide wheel 22 is moving from front to back, and removed when the guide wheel is moving from back to front. This produces a faster reversal of direction which helps the strip climb over the edge of the previous layer. The forementioned front face is away from the winding machine with the back face being towards the machine. When the mandrel is rotating in a direction to receive material, the guide wheel traverses from front face to back face to front face to back face, etc. As the guide wheel translates to the back face, the position offset which is only present during that time while winding from front face to back face causes a sharper reversal of the material as laid on the coil to aid reversing or to counter the forces which would push that strip off the edge of the coil.

We claim:

1. An apparatus for winding rigid strip material into a coil without side restraints, comprising a mandrel for receiving the strip material; means for rotating the mandrel about a first axis; guide means mounted adjacent to said mandrel and operable to guide said strip material from a source onto the surface of said mandrel, and means for moving said guide means along a second axis parallel to said first axis whereby said strip material is helically wound onto said rotating mandrel; the improvement comprising said means for moving said guide means along said second axis including a linear actuator connected to said guide means and operable to move said guide means along said second axis between a first position aligned with a first predetermined point on the surface of said mandrel and a second position aligned with a second predetermined point on the surface of said mandrel, and control means operatively connected to said actuator means for controlling movement of said guide means along said second axis in synchronization with the angular position of said mandrel, said control means including means for counting the number of turns of said strip material in each material layer on said mandrel and means for setting the lead width between adjacent turns of said strip material in each material layer on said mandrel, said counting means including a digital counter, a comparator, and switch means for presetting the number of turns desired, said comparator comparing the count stored in said digital counter with said preset number of turns and producing an output signal that is a function of the number of turns of said material in the layer being wound on said mandrel, said lead width setting means including amplifying means and switch means for presetting the lead width desired, said amplifying means being electrically connected to said output signal of said comparator and having its gain regulated by said lead width switch means so as to produce an output signal that is a function of the number of turns and the lead width between adjacent turns of said strip material in each material layer on said mandrel to control said linear actuator in moving said guide means along said second axis.

2. Apparatus as claimed in claim 1, including a frame and means mounting said mandrel on said frame, said guide means comprising a shaft mounted on said frame for linear movement along said second axis, and a guide wheel mounted on said shaft for rotation about said second axis and adapted to receive said strip material about its periphery.

3. Apparatus as claimed in claim 1 wherein said control means includes servo means operable to provide direction control signals to said linear actuator, and signal generator means operatively connected to said mandrel and operable to provide a mandrel position signal to said servo means, said guide means being movable between said first and second positions in response to position reference signals proportional to the angular position of said mandrel.

4. Apparatus as claimed in claim 3, wherein said control means further includes means providing a feedback signal to said servo means proportional to the position of said guide means along said second axis.

5. Apparatus as claimed in claim 4, in which said linear actuator comprises a pressure cylinder, and said means providing a feedback signal comprises a linear variable differential transformer operatively connected to the piston rod of said pressure cylinder.

6. Apparatus as claimed in claim 1, including a placing roll rotatable about a third axis parallel to said first and second axis and disposed between said mandrel and said guide means, said strip material passing over said guide means, over said placing roll and then onto said mandrel; and means biasing said placing roll into contract with the coil formed on said mandrel.

7. Apparatus as claimed in claim 6 including means connected to said biasing means and operable to selectively lift said placing roll of said coil.

8. Apparatus as claimed in claim 1, including a frame, means mounting said mandrel on said frame for rotation about said first axis, means mounting said guide means on said frame for movement along said second axis, and a placing roll mounted on said frame for rotation about a third axis parallel to said first and second axis, said placing roll being operable to transfer said strip material passing over said guide means onto the surface of said mandrel.

9. Apparatus as claimed in claim 8 including means mounted on said frame supporting said placing roll for movement in an arcuate path toward and away from said mandrel, and means acting on said supporting means biasing said placing roll into contact with the strip material wound on said mandrel.

10. Apparatus as claimed in claim 9 in which said means supporting said placing roll comprises an arm pivotally mounted on said frame, and said biasing means comprises a pressure cylinder acting between said arm and said frame.

11. Apparatus as claimed in claim 10, including control means operatively associated with said pressure cylinder for normally pressurizing one side of said pressure cylinder to bias said placing roll into contact with said coil, and for selectively pressurizing the opposite side of said pressure cylinder to lift said placing roll off said coil.

12. An apparatus for winding rigid strip material into a coil without side restraints, comprising a mandrel for receiving the strip material; means for rotating the mandrel about a first axis; guide means mounted adjacent to said mandrel and operable to guide said strip material from a source onto the surface of said mandrel, and means for moving said guide means along a second axis parallel to said first axis whereby said strip material is helically wound onto said rotating mandrel; the improvement comprising said means for moving said guide means along said second axis including a linear actuator connected to said guide means and operable to move said guide means along said second axis between a first position aligned with a first predetermined point on the surface of said mandrel and a second position aligned with a second predetermined point on the surface of said mandrel, and control means operatively connected to said actuator means for controlling movement of said guide means along said second axis in synchronization with the angular position of said mandrel, said control means including means for comparing the actual number of turns of said strip material on the mandrel with a predetermined number of turns and producing a first signal indicative thereof, means for setting the lead width between adjacent turns of said strip material in each material layer on said mandrel and producing a second signal indicative thereof and means for utilizing said first and second signals to produce a third signal for controlling said linear actuator in moving said guide means so as to produce an accurately formed helix of strip material on said mandrel.

* * * * *